United States Patent [19]

Bihler

[11] 4,186,581

[45] Feb. 5, 1980

[54] DRIVE ARRANGEMENT FOR A TOOL CARRIAGE OF A MACHINE TOOL

[76] Inventor: Otto Bihler, Schleiferweg 2, D-8959 Halblech, Füssen, Fed. Rep. of Germany

[21] Appl. No.: 932,648

[22] Filed: Aug. 10, 1978

[30] Foreign Application Priority Data

Sep. 13, 1977 [DE] Fed. Rep. of Germany ..... 2741150

[51] Int. Cl.[2] ..... B21J 7/46; B21D 55/00; B21J 9/18

[52] U.S. Cl. ..... 72/26; 10/23; 72/445; 72/452; 100/266; 100/292

[58] Field of Search ..... 72/26, 452, 445; 100/291, 292, 266; 10/23, 89 F, 11 R, 12 R

[56] References Cited

U.S. PATENT DOCUMENTS

| | | | |
|---|---|---|---|
| 661,618 | 11/1900 | Nusser | 72/445 |
| 1,167,341 | 1/1916 | Finckh | 10/11 R |
| 2,184,356 | 12/1939 | Lindgren | 100/266 |
| 2,483,597 | 10/1949 | Schogren | 72/445 |

FOREIGN PATENT DOCUMENTS

| | | | |
|---|---|---|---|
| 415402 | 6/1925 | Fed. Rep. of Germany | 72/452 |
| 867799 | 2/1953 | Fed. Rep. of Germany | 72/452 |

*Primary Examiner*—Francis S. Husar
*Assistant Examiner*—Gene P. Crosby
*Attorney, Agent, or Firm*—Toren, McGeady and Stanger

[57] ABSTRACT

A tool carriage for a machine tool is mounted on a support for movement between a working position and a rest position. The machine drive moves the carriage in a path from the rest position into the working position and thereafter permits return to the rest position. A spring interposed between the carriage and the support is stressed during carriage movement into the working position so that the stressed spring biases the carriage to return to the rest position. An auxiliary return device supplements the biasing force of the spring and thereby augments the force available for returning the carriage toward the rest position at least in a position of the carriage adjacent the working position.

21 Claims, 6 Drawing Figures

DRIVE ARRANGEMENT FOR A TOOL CARRIAGE OF A MACHINE TOOL

This invention relates to machine tools, and particularly to a tool carriage arrangement for a machine tool.

The movements of a tool carriage in a machine tool must be synchronized precisely with all other operations of the machine tool. Any movement of a tool carriage out of phase with other machine movements can cause severe damage to the machine and to a workpiece on the machine. Precise synchronization of tool carriage movement can be had by means of a dual cam drive, respective cams causing forward movement of the carriage into its working position and return movement to the rest position. It is relatively simple to provide a tool carriage driven by two cams in opposite directions with safety devices which stop the machine drive in the event of excessive resistance of the carriage to the driving forces as may occur, for example, if a workpiece is not ejected properly or if transverse forces cause wedging engagement of workpiece and tool and jamming of the carriage. The latter type of malfunctioning is frequently observed at the start of the carriage return stroke.

Dual cam drives are relatively expensive to build and to maintain in good working condition and are employed mainly in high-speed machine tools. In others, return springs are preferred to cooperate with single cam drives which move the carriage into the working position and permit return by the spring. The spring also maintains contact between a cam follower drivingly connected to the carriage and the drive cam. A return spring, however, is not well suited for overcoming the resistance of the carriage to return movement if the tool is jammed and causes excessive friction between the carriage and associated guides. Such resistance requires a spring force several times greater than that needed for normal carriage return. If the return spring is selected to provide the high biasing force necessary for reliable operation under unfavorable conditions, the force required for stressing the spring during each forward movement of the carriage into the working position substantially increases wear of guides and other elements cooperating with the carriage. The return spring also has to be replaced whenever the stroke of the tool carriage is to be changed. Otherwise, it would be necessary to employ a spring suitable for providing an adequate biasing force for the return movement after the shortest forward stroke of which the carriage is capable, and such a spring would offer enormous resistance to the forward movement at the longest available carriage stroke.

The primary object of this invention is the provision of a carriage arrangement in which the carriage is biased toward the rest position by a relatively weak spring, yet a strong return force is provided at least while the carriage still is near its working position.

The invention thus improves a known tool carriage arrangement having a return spring with an auxiliary return device for supplementing the biasing force of the spring and for thereby augmenting the force available for returning the carriage toward the rest position at least in a position of the carriage adjacent its working position.

Other features, additional objects, and many of the attendant advantages of this invention will readily be appreciated as the same becomes better understood by reference to the following detailed description of preferred embodiments when considered in connection with the appended drawing in which.

Figure 1:
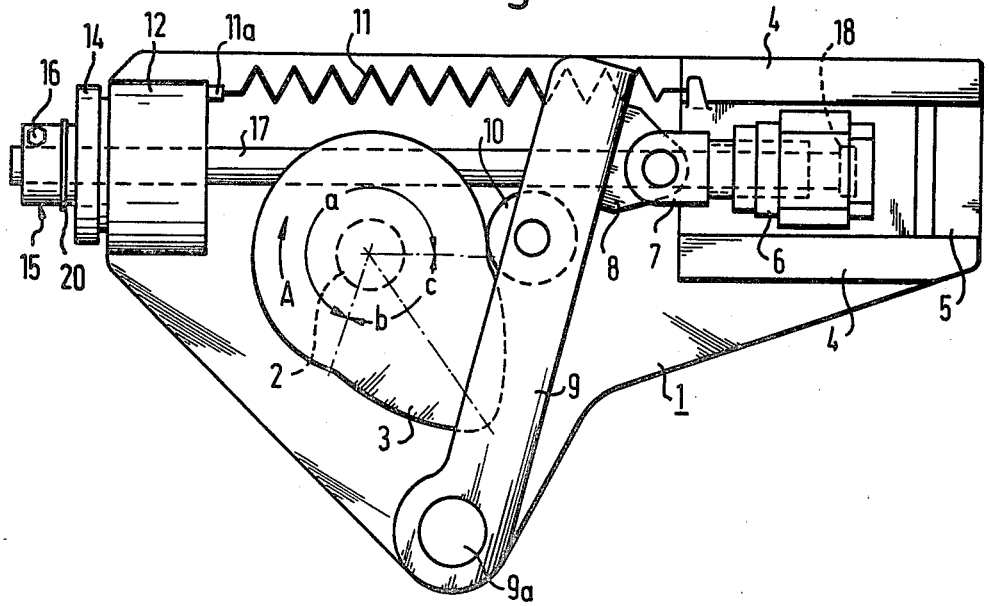
FIG. 1 shows a tool carriage arrangement of the invention in top plan view.

Referring now to the drawing in detail, and initially to FIG. 1, there is seen a representative tool carriage arrangement of the invention of a type suitable, for example, for automatic bending and punching machines. A carriage support 1 provides a journal for a drive shaft 2 connected with the main drive of the machine in a conventional manner, not illustrated. It carries a radial cam 3. Guide rails 4 spacedly mounted on the support 1 receive a tool carriage 5 therebetween. A tool may be set into the carriage 5 in the usual manner, not shown. Nuts 6 permit a forked rod 7 to be adjusted on the carriage 5 in the direction of carriage movement. An abutment 8 is pivotally mounted on the forked end of the rod 7. A rocker arm 9 mounted on the support 1 by means of a pin **9*a* for angular movement about an axis parallel to the shaft 2 carries a cam follower roller 10 held in engagement with the cam face of the cam 2 by the abutment 8 engaging the rocker arm 9 under the biasing force of a helical tension spring 11 mounted between a boss 11*a* on a cup-shaped housing 12 and a similar boss on the carriage 5**.

Figure 2:
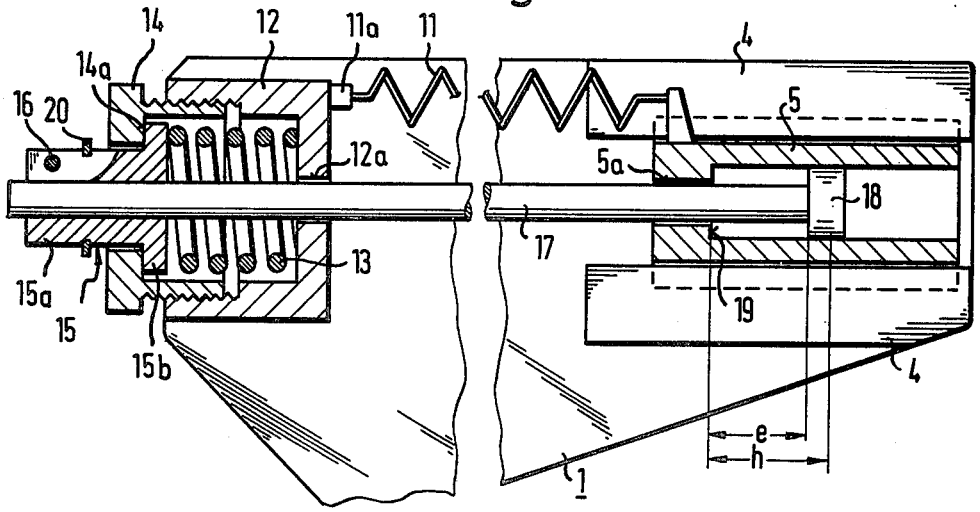
FIG. 2 illustrates elements of the arrangement of FIG. 1 in fragmentary plan section on a scale greater than that of FIG. 1.

The housing 12, seen in greater detail in FIG. 2, is mounted on the support 1 and is normally stationary on the support. It encloses a helical compression spring 13 confined between spring seats on an inner wall of the housing and on a flange **15*b* of a collet 15 whose slotted stem portion 15*a* projects from the housing 12. The collet is adjustably retained in the housing 12 by a shoulder 14*a* of a bushing 14 whose external threads engage mating threads in the housing 12. A clamping screw 16 normally tightens the slotted stem 15*a* on a connecting rod 17 coaxial with the spring 13 which is slidably guided in a bore 12*a* in the bottom wall of the housing 12 and a bore 5*a* of the carriage 5. The bore 5*a* is of stepped cylindrical shape, and its wider portion receives an enlarged head 18 of the rod 17 so that a shoulder 19 of the carriage 5 in the bore 5*a* limits movement of the rod 17 outward of the carriage 5. An abutment ring 20 on the stem 15*a* of the collet 15 limits movement of the rod 17 with the collet 15 inward of the carriage 5**.

The cam 3 is turned by the shaft 2 in the direction of an arrow A. A circularly arcuate portion of the cam face extends about the axis of rotation over an angle a of approximately 255°, and the carriage 5 stands still in the rest position illustrated in FIGS. 1 and 2 as long as the cam follower roller 10 engages the circularly arcuate cam face portion. The single, approximately symmetrical lobe of the cam 3 causes the carriage 5 to be advanced toward a non-illustrated workpiece against the restraint of the spring 11 while the cam follower travels over the cam face portion extending about an angle b, and the spring 11 is permitted to return the carriage 5 toward the rest position when the cam follower travels over the cam face portion defined by an angle c.

As is seen in FIG. 2 the rod head 18 is spaced a distance e from the shoulder 19 in the rest position of the carriage, and the rod 17 and associated elements stand still during the lost motion e of the shoulder 19 in the early part of the cam-actuated advance stroke h of the carriage. Only during the terminal phase of the advance stroke, the shoulder 19 abuttingly engages the head 18 and moves the rod 17 against the supplemental restraint of the compression spring 13. If the carriage jams in the working position, the combined forces of the spring 11 and of the much stronger spring 13 are available for breaking the carriage loose so that continued engagement of the cam follower 10 with the face of the cam 3 may thereafter be ensured by the spring 11 alone.

The initial stress of the spring 13 may be adjusted by threadedly moving the bushing 14 in the housing 12. Because of the relatively short portion h−e of the advance stroke h during which the strong spring 13 is compressed, the additional energy consumed by stressing the spring is insignificant. The abutment ring 20 limits the reduction in the axial length of the spring 13 in the event of faulty adjustment of the bushing 14. The lost motion e may be set to a desired value by releasing the screw 16 and shifting the rod 17 in the collet 15 before again tightening the screw 16.

Figure 3:
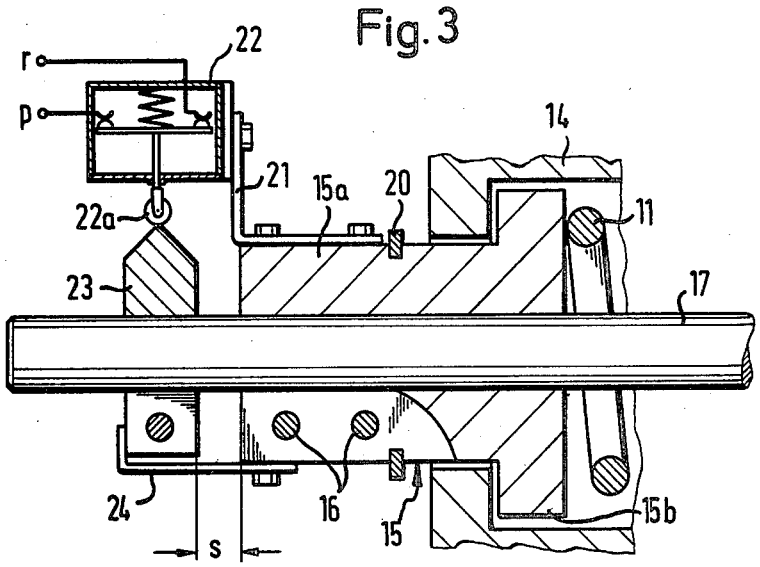
FIG. 3 shows a portion of the device of FIG. 2 on a further enlarged scale and equipped with an auxiliary switch.

FIG. 3 shows a tool carriage arrangement of the invention identical with the device illustrated in FIGS. 1 and 2 as far as not shown, and carrying a supplemental device which prevents accidental inactivation of the spring 13.

An angle bracket 21 attached to the stem 15*a* of the collet 15 carries a normally open switch 22 whose actuator 22*a* is normally engaged by a switch operating cam 23 clamped on the end portion of the rod 17 which projects from the collet 15 so that the switch 22 connects terminals p, r of a non-illustrated relay in the energizing circuit of the machine, of an alarm bell, not shown, or of any device generating a suitable electrical signal. If the rod 17 is moved by the advancing carriage 5 after the abutment ring 20 engages the bushing 14 and stops the collet 15, the rod slips in the collet, and the switch actuator 22*a* is released by the cam 23, permitting the switch 22 to be opened by a built-in compression spring. An angle bracket 24 on the collet 15 precisely defines the spacing s between the cam 23 and the opposite face of the collet 15 which is sufficient for stopping the machine automatically or by an operator warned by a sensible alarm before engagement of the cam 23 with the collet 15 can change the setting of the cam 23.

Figure 4:
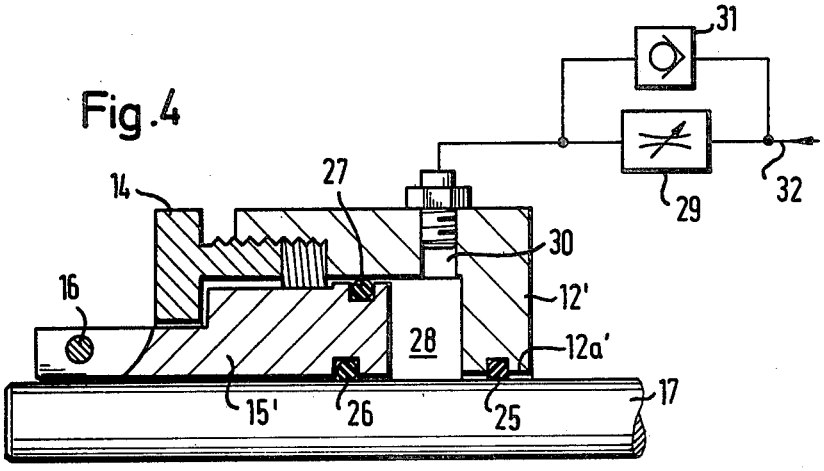
FIG. 4 illustrates a modification of the device of FIG. 2 in a fragmentary, sectional, plan view.

In the modified tool carriage arrangement illustrated in FIG. 4 only to the extent that it differs from the apparatus described above with reference to FIGS. 1 and 2, the metallic compression spring 13 is replaced by a pneumatic spring whose cylinder is constituted by a slightly modified housing 12', and whose piston is constituted by the similarly modified collet 15'.

The rod 17 is slidably sealed in the bore 12*a'* of the housing 12' by an elastomeric sealing ring 25, and two additional sealing rings 26, 27 seal the collet 15' to the rod 17 and the housing 12' respectively. The maximum volume of the cavity 28 of the housing 12' may be enlarged and reduced by adjusting the bushing 14 in the manner described above and for the same purpose. The cavity 28 is charged with compressed air or another gas from a pressure line 32 through an adjustable throttling valve 29 by-passed by a check valve 31 in a conventional manner and communicating with the cavity 28 through a nipple in a bore 30 of the housing 12', so that fluid may flow through the check valve only in direction from the pressure line 32 to the cavity 28.

Figure 5:
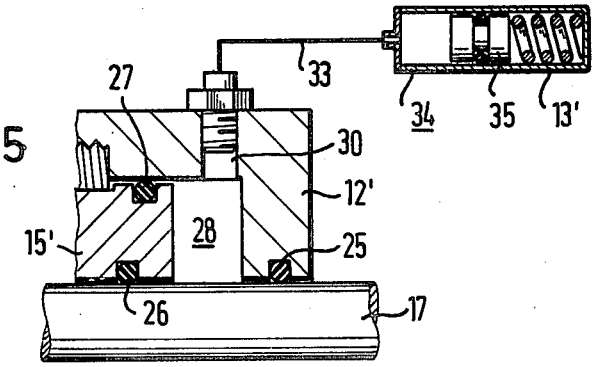
FIG. 5 shows a further modification of the apparatus of FIG. 4.

In the carriage arrangement shown in FIG. 5 and identical with the device of FIG. 4, as far as not described and illustrated otherwise, the nipple in the bore 30 is connected by a flexible hose 33 to a cylinder 34 in which a piston 35 is backed by compression spring 13'. The cylinder 34 may be mounted on the machine or even elsewhere in any conveniently available space. The chamber in the cylinder 34, the hose 33, and the cavity 28 are filled with a fluid which transmits the biasing force of the spring 13' to the rod 17, and thereby to the tool carriage 5 during the initial phase of the carriage return as in the devices of FIGS. 1 to 4. A gas, a liquid, or both may be used as the transmitting fluid.

Figure 6:
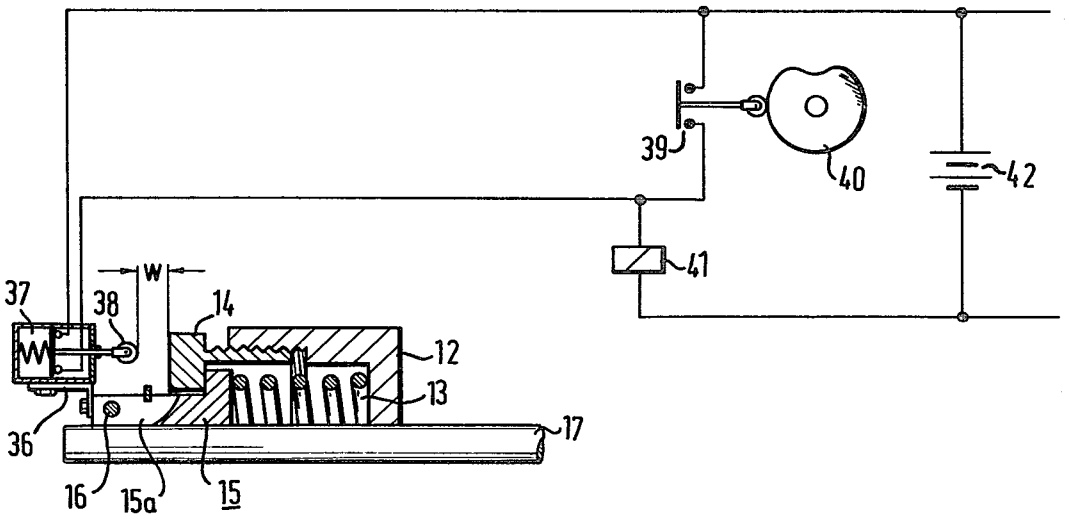
FIG. 6 shows elements of the tool carriage arrangement of FIGS. 1 and 2 with supplemental devices partly represented by conventional symbols.

FIG. 6 shows only as much of the tool carriage arrangement of FIGS. 1 and 2 as is necessary for illustrating the operation of a supplemental safety mechanism for stopping the machine if the biasing force of the spring 13 is insufficient for releasing the carriage 5 from its advanced or working position, and for thereby preventing the damage to machine and workpiece that could result from a tool remaining in its operating position outside its proper working cycle.

An angle bracket 36 attached to the collet 15 carries a normally closed limit switch 37 whose actuating element 38 is directed toward the transverse end face of the bushing 14. The switch 37 is arranged in parallel circuit with another switch 39 in the line connecting a relay 41 with a source of energizing current 42 illustrated as a battery. A radial cam 40 is rotated by the main drive of the machine in the manner described with reference to cam 3. The cam face of the cam 40 is circular about its axis of rotation except for a notch synchronized with the operation of the carriage 5 in such a manner that the actuating element of the switch 39 closes the switch 39 only when the carriage 5 is in its working position at or contiguously adjacent the end of its stroke h, the switch 39 being open, as shown, in all other positions of the carriage 5.

The spacing W of the actuating element 38 from the bushing 14 is sufficient to open the switch 37 only when the rod 17 is advanced to its limiting position corresponding to the working or operating position of the tool carriage 5. The contacts of the relay 41, not themselves shown, are arranged in the energizing circuit of the main machine drive in such a manner that the machine is stopped when the winding of the relay is disconnected from its current source 42. The connection is normally maintained in the working position of the carriage 5 by the cam-operated switch 39 while the switch 37 is opened by abutting engagement of its actuating element 38 with the bushing 14. Under all other normal conditions, the relay 41 is energized through the switch 37 while the switch 39 is open. If the carriage 5 is stuck in its working position, the switch 37 remains open when the switch 39 is opened by the cam 40, and the machine is stopped.

The helical compression springs 13, 13' and the pneumatic compression sping 12', 15' are merely representative of supplemental biasing devices for increasing the force available for return of the carriage 5 from a position contiguously adjacent its limiting working position.

Others will readily suggest themselves and may be substituted in the carriage arrangement of the invention without significant change in function. Thus, a tension spring may replace the illustrated compression springs, and the necessary structural changes will be obvious from the illustrated tensioning arrangement for the spring 11. Similarly, the cylinder-and-piston devices shown in FIGS. 4 and 5 may be supplied cyclically with pressure fluid in proper synchronization with the movement of the cam 3. For this purpose, the piston 35 shown in FIG. 5 may be equipped with a piston rod carrying a cam follower engaging a radial cam that pumps fluid into the cavity 28 from the chamber of the cylinder 34 at the beginning of the return phase of carriage movement. As compared to a helical spring, the cylinder-and-piston devices permit a constant, supplemental, return force to be exerted on the carriage 5 independent from the actual position of the carriage in its stroke portion h−e.

The illustrated tension spring 11 may be replaced by a helical compression spring suitably interposed between the carriage 5 and the support 1, and a pneumatic spring of the types illustrated, or of the supplemental types referred to in the preceding paragraph may be substituted for a helical spring. If the housing 12 is releasably mounted on the support 1 for convenient access to elements mounted therein, the spring 11 may be attached to the support 1 directly to avoid removal of the spring if the housing 12 is separated from the support. In the illustrated embodiments of the invention, the spring 11 is transversely offset from the rod 17. If available space is limited, the spring 11 may also be coiled about the rod 17 and attached to the carriage 5 and the housing 12 in a suitable manner different from what is shown in FIGS. 1 and 2.

It should be understood, therefore, that the foregoing disclosure relates only to preferred embodiments, and that it is intended to cover all changes and modifications of the examples of the invention herein chosen for the purpose of the disclosure which do not constitute departures from the spirit and scope of the invention set forth in the appended claims.

I claim:

1. In a tool carriage arrangement for a machine tool including a support, a tool carriage mounted on said support for movement between a working position and a rest position, drive means for moving said carriage in a path from said rest position into said working position and for thereafter permitting return of said carriage to said rest position, and a spring interposed between said carriage and said support in a manner to stress said spring during said moving, whereby the stressed spring biases the carriage to return from said working position to said rest position, the improvement which comprises auxiliary return means for supplementing the biasing force of said spring and for thereby augmenting the force available for returning the carriage toward said rest position at least in a position of said carriage adjacent said working position.

2. In an arrangement as set forth in claim 1, said auxiliary return means including a cylinder member, a piston member bounding a chamber in said cylinder member, force transmitting means connecting said members to said support and to said carriage respectively, and means for supplying a liquid under pressure to said chamber in said position of the carriage adjacent said working position.

3. In an arrangement as set forth in claim 1, said drive means including a cam rotatable on said support, a cam follower engaging said support, and motion transmitting means operatively connecting said cam follower to said carriage.

4. In an arrangement as set forth in claim 1, safety means for inactivating said drive means in response to failure of said carriage to return from said working position to said rest position under the biasing force of said spring supplemented by said auxiliary return means.

5. In an arrangement as set forth in claim 4, said safety means including a first switch, first switch control means for opening said switch when said carriage is in said working position thereof, and for closing said switch when said carriage is not in said working position, a second switch, second switch control means operatively connected to said drive means for closing said second switch when said carriage is in said working position, and for opening said second switch when said drive means permit return of said carriage to said rest position, and signal generating means in circuit with said first and second switches for generating an electrical response when said first and second switches are open simultaneously.

6. In an arrangement as set forth in claim 1, said auxiliary return means including a supplemental spring interposed between said support and said carriage in a manner to stress said supplemental spring during said moving only while said carriage is in a portion of the path thereof adjacent said working position.

7. In an arrangement as set forth in claim 6, means for holding said supplemental spring under stress in all positions of said carriage in said path thereof.

8. In an arrangement as set forth in claim 6, a lost-motion linkage interposed between said carriage and said supplemental spring for preventing stressing of said supplemental spring during said moving while said carriage is in said portion of the path thereof adjacent said rest position.

9. In an arrangement as set forth in claim 8, adjusting means in said linkage for varying the respective lengths of said portions.

10. In an arrangement as set forth in claim 8, said linkage including a connecting rod guided on said carriage for movement in the direction of said path, said rod having an enlarged portion, and said carriage including abutment means spaced from said enlarged portion in said rest position of the carriage and engaging said enlarged portion when said carriage is in said portion of the path thereof adjacent said working position.

11. In an arrangement as set forth in claim 10, a housing mounted on said support in a fixed position and defining a first spring seat, a second spring seat secured to said rod for joint movement, said supplemental spring being arranged in said housing between said spring seats.

12. In an arrangement as set forth in claim 11, switch means interposed between said second spring seat and said rod and responsive to relative movement of said second spring seat and said rod for generating an electrical signal.

13. In an arrangement as set forth in claim 8, an abutment member mounted on said housing for limiting movement of said second spring seat relative to said first spring seat in a direction to reduce the stress of said supplemental spring.

14. In an arrangement as set forth in claim 13, adjusting means for adjusting the position of said abutment member on said housing in the direction of said path.

15. In an arrangement as set forth in claim 14, securing means releasably securing said second spring seat to said rod for joint movement, and permitting movement of said second spring seat in the direction of said path relative to said rod when released.

16. In an arrangement as set forth in claim 15, said housing being cup-shaped and including a bottom wall constituting said first spring seat, said bottom wall being formed with a bore for passage therethrough of said rod, a collet being clamped releasably on said rod and partly received in said housing to constitute said second spring seat, said supplemental spring being a compression spring, said abutment member being a bushing threadedly mounted in said housing and movably receiving a portion of said collet.

17. In an arrangement as set forth in claim 16, said supplemental spring including a body of gas.

18. In an arrangement as set forth in claim 17, said housing constituting the cylinder of a gas spring and bounding therein a cavity containing said body of gas, and said collet constituting the piston of said gas spring and being movably sealed to said housing in said cavity.

19. In an arrangement as set forth in claim 18, adjustable throttling valve means communicating with said cavity for controlling gas pressure in the cavity.

20. In an arrangement as set forth in claim 18, a source of fluid under pressure, and a check valve connecting said cavity to said source for flow of fluid from said source toward said cavity only.

21. In an arrangement as set forth in claim 18, another cylinder, another piston in said other cylinder, said piston bounding a chamber in said other cylinder, a conduit connecting said chamber to said cavity, said chamber and said conduit being filled with fluid, and a spring biasing said other piston inward of said chamber.

* * * * *